US005450681A

United States Patent [19]

Stolzman

[11] Patent Number: 5,450,681

[45] Date of Patent: Sep. 19, 1995

[54] INTERMEDIATE BULK CONTAINER MARKING PLATE

[76] Inventor: Michael D. Stolzman, 28468 N. Ballard Dr., Lake Forrest, Ill. 60045

[21] Appl. No.: 44,727

[22] Filed: Apr. 12, 1993

[51] Int. Cl.[6] ..... G09F 3/00

[52] U.S. Cl. ..... 40/308; 40/316; 40/611

[58] Field of Search ..... 40/308, 316, 611

[56] References Cited

U.S. PATENT DOCUMENTS

| | | | |
|---|---|---|---|
| 4,496,058 | 1/1985 | Harris et al. | 40/308 |
| 4,760,660 | 8/1988 | Fast | 40/308 |
| 4,761,904 | 8/1988 | Fast et al. | 40/308 |

FOREIGN PATENT DOCUMENTS

| | | | |
|---|---|---|---|
| 1484281 | 9/1977 | United Kingdom | 40/308 |

*Primary Examiner*—Richard D. Bertsch
*Assistant Examiner*—Willaim J. Wicker
*Attorney, Agent, or Firm*—Wood, Phillips, VanSanten, Clark & Mortimer

[57] ABSTRACT

A removable marking plate is provided for use with an intermediate bulk container including a vessel surrounded by a wire mesh cage. The marking plate comprises a rectangular plate with a front surface and a rear surface to be carried on the cage with the rear surface in surface contact with the cage. The front surface is adapted to receive marking information. A plurality of first fasteners are provided. Each comprises an arm extending rearwardly from the plate along one side to define a pocket for capturing a portion of wire from the cage between the arm and the rear surface to pivotally retain the plate on the cage. A plurality of second fasteners extend rearwardly from the plate other than at the one side edge. Each second fastener includes a second pocket for capturing a portion of wire from the cage to retain the plate on the cage and a rearwardly opening passage narrower than a diameter of the wire and opening to the second pocket so that pivotal movement of the plate about the first fasteners positions the passage at a portion of wire from the cage to be received in the second pocket to provide a snap fit for retaining the wire in the second pocket while permitting removal therefrom.

11 Claims, 2 Drawing Sheets

INTERMEDIATE BULK CONTAINER MARKING PLATE

FIELD OF THE INVENTION

This invention relates to intermediate bulk storage containers and, more particularly, to an improved marking plate therefor.

BACKGROUND OF THE INVENTION

For shipment of bulk goods, a storage system known as an intermediate bulk container (IBC) has found wide acceptance. The intermediate bulk container comprises a 275 gallon container mounted to a skid or pallet. A wire mesh cage is also mounted to the skid and surrounds the container on all four sides. The top of the container is generally exposed. Additional pallets or intermediate bulk containers can then be stacked for shipping or storage.

A shipper of goods must provide suitable labeling to identify, for example, the goods stored in the container, the shipper and the receiver of the goods. The problem exists, however, in adhering labels to the wire mesh cage. In the past this problem has been solved using a metal marking plate which is stamped with tabs. The tabs are bent around the wire of the mesh cage and then welded, so that the marking plate becomes an integral part of the cage.

The conventional marking plate is commonly used by applying adhesive labels to the marking plate or adhering labels with an adhesive tape or liquid adhesive substance. These labels are generally non-removable without being destroyed and leaving some residue on the marking plate which eventually builds up, possibly rendering the marking plate non-usable. Due to the weld connection, removal of the marking plate is difficult without damaging the wire mesh cage. If removed, it is nothing more than scrap metal which is non-usable.

The present invention is directed to overcoming one or more of the problems discussed above.

SUMMARY OF THE INVENTION

In accordance with the invention there is provided a plastic marking plate for an intermediate bulk container.

Broadly, there is disclosed herein a removable marking plate for use with a storage apparatus including a wire mesh cage. The marking plate comprises a plate with a front surface and a rear surface and having a shape corresponding to shape of the wire mesh cage to be carried on the cage with the rear surface in surface contact with the cage. The front surface is adapted to received marking information. A plurality of fasteners extend rearwardly from the plate. Each fastener includes a pocket for capturing a portion of wire from the cage to retain the plate on the cage and a passage narrower than a diameter of the wire in opening to the package provide a snap fit for retaining the wire in the pocket while permitting removal therefrom. The marking plate is of one piece plastic construction.

It is a feature of the invention that the plate is rectangular and the fasteners are spaced along opposite edges of the rectangular plate.

It is another feature of the invention that the fasteners are spaced along top and bottom edges of the plate.

It is a further feature of the invention that at least some of the fasteners comprise an arm connected at one end to the plate and extending generally parallel to the rear surface to define the pocket and having a shoulder at a distal end extending toward the rear surface to define the passage, such fasteners hingedly mounting the plate to the cage.

It is yet another feature of the invention that at least some of the fasteners comprise a pair of opposite fingers spaced apart a distance at least equal to the diameter of the wire to define the pocket, the fingers outwardly converging toward one another so that the distal edges are spaced apart a narrower distance to define the passage.

In accordance with another aspect of the invention there is disclosed a removable marking plate for use with an intermediate bulk container including a vessel surrounded by a wire mesh cage. The marking plate comprises a rectangular plate with a front surface and a rear surface to be carried on the cage with the rear surface in surface contact with the cage, The front surface is adapted to receive marking information. A plurality of first fasteners are provided. Each comprises an arm extending rearwardly from the plate along one side to define a pocket for capturing a portion of wire from the cage between the arm and the rear surface to pivotally retain the plate on the cage. A plurality of second fasteners extend rearwardly from the plate other than at the one side edge. Each second fastener includes a second pocket for capturing a portion of wire from the cage to retain the plate on the cage and a rearwardly opening passage narrower than a diameter of the wire and opening to the second pocket so that pivotal movement of the plate about the first fasteners positions the passage at a portion of wire from the cage to be received in the second pocket to provide a snap fit for retaining the wire in the second pocket while permitting removal therefrom.

It is a feature of the invention that the marking plate front surface comprises a generally flat surface and the rear surface includes a plurality of rearwardly extending reinforcement ribs.

It is a further feature of the invention that the ribs are configured to form a rib grid.

Further features and advantages of the invention will be readily apparent from the specification and from the drawing.

DETAILED DESCRIPTION OF THE INVENTION

Figure 1:
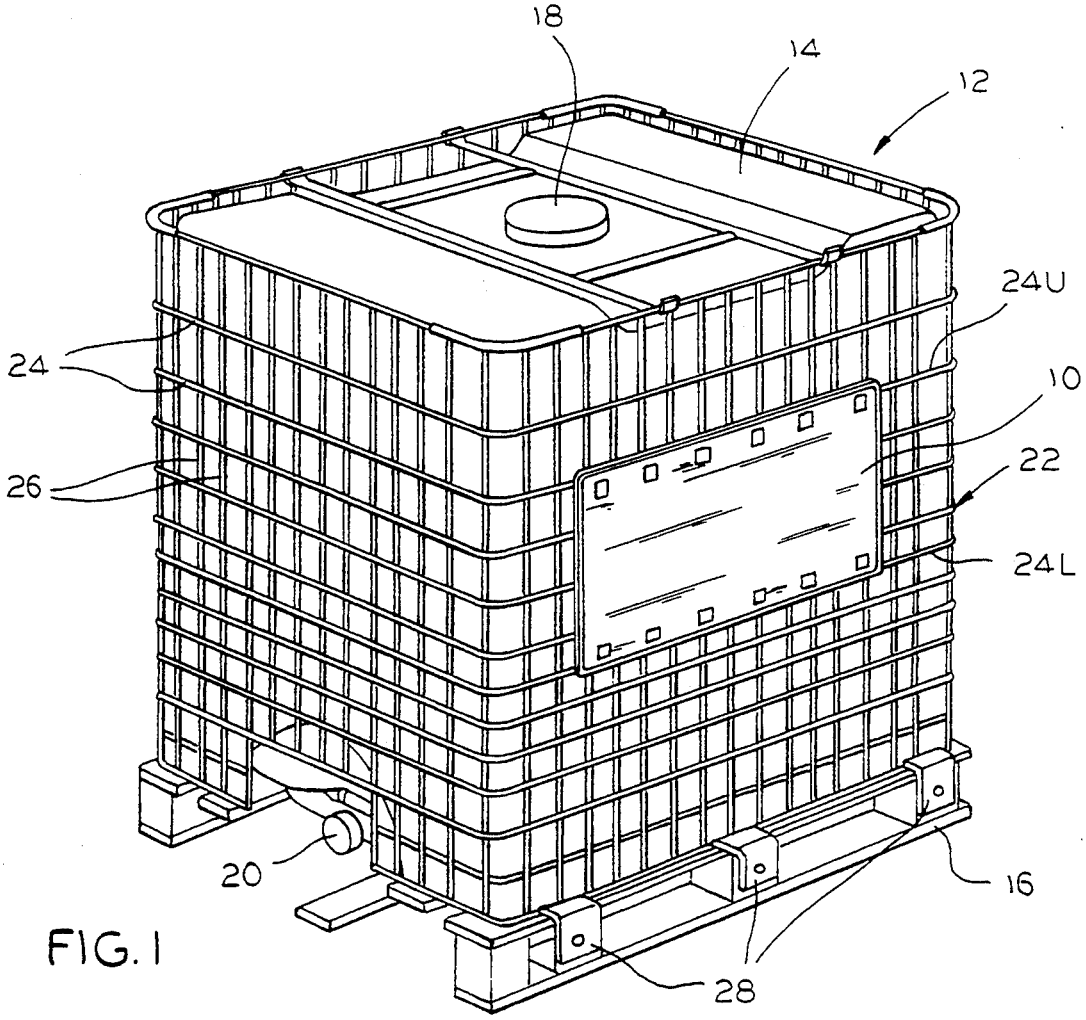
FIG. 1 is a perspective view of an intermediate bulk container including a marking plate according to the invention.
Figure 2:
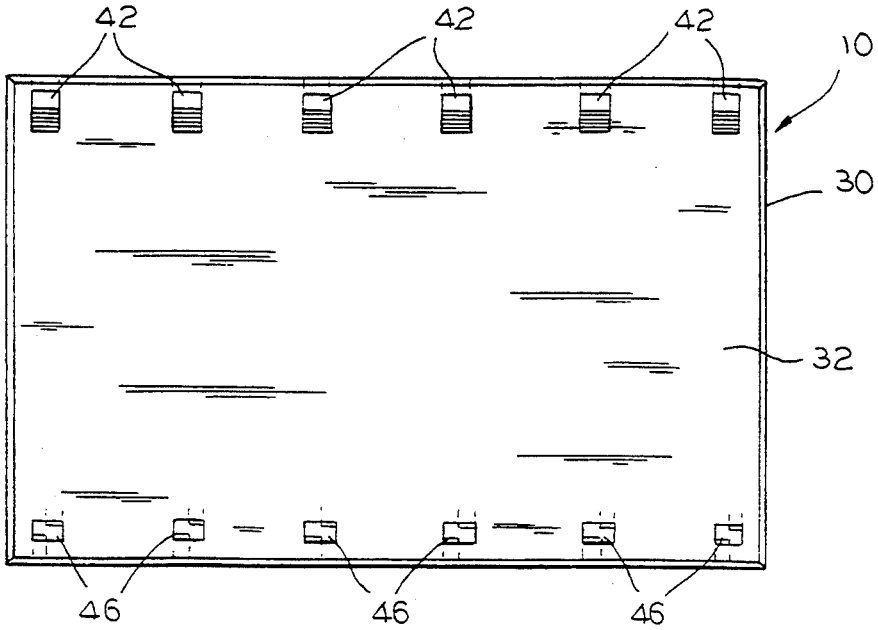
FIG. 2 is a front elevation view of the marking plate of FIG. 1.

Referring to FIG. 1, a marking plate 10 according to the invention is illustrated fastened to an intermediate bulk container (IBC) 12. The intermediate bulk container comprises a 275 gallon plastic vessel 14 resting on a pallet or skid 16. The container 14 can be filled at its top as by removing a cover 18 providing access to an opening (not shown). A bottom spout 20 acts as an outlet for goods stored in the vessel 14. The vessel 14 is surrounded on all four sides by a wire mesh cage 22. The cage 22 comprises a plurality of horizontal wires 24 extending around all four sides of the vessel 14 and connected to a plurality of vertically extending wires 26. The cage 22 is secured to the pallet using brackets 28.

In accordance with the invention, the marking plate 10 includes fasteners for fastening the marking plate 10 to the horizontal wires 24 of the cage 22 and permitting easy removal.

With reference to FIGS. 2–8, the marking plate 10 is of one piece molded plastic construction. Particularly, the marking plate 10 may be molded of polystyrene. The marking plate 10 includes a rectangular plate 30 having a generally flat front surface 32 and a rear surface 34. The rear surface 34 includes a rib grid 36 formed with a plurality of intersecting vertical ribs 38 and horizontal ribs 40. The ribs 38 and 40 reinforce the plate 30 to prevent it from wobbling.

Integrally molded to the plate 30 are a plurality of first fasteners 42 longitudinally spaced from one another immediately adjacent a top edge 44 and a plurality of second fasteners 46 longitudinally spaced from one another immediately adjacent an opposite bottom edge 48. In the illustrated embodiment of the invention, the marking plate 10 includes six first fasteners 42 and six second fasteners 46. As will be apparent to one skilled in the art, more or less of either type fastener could be used as well as being at different positions.

Figures 3, 4, 5, 6, 7, 8:
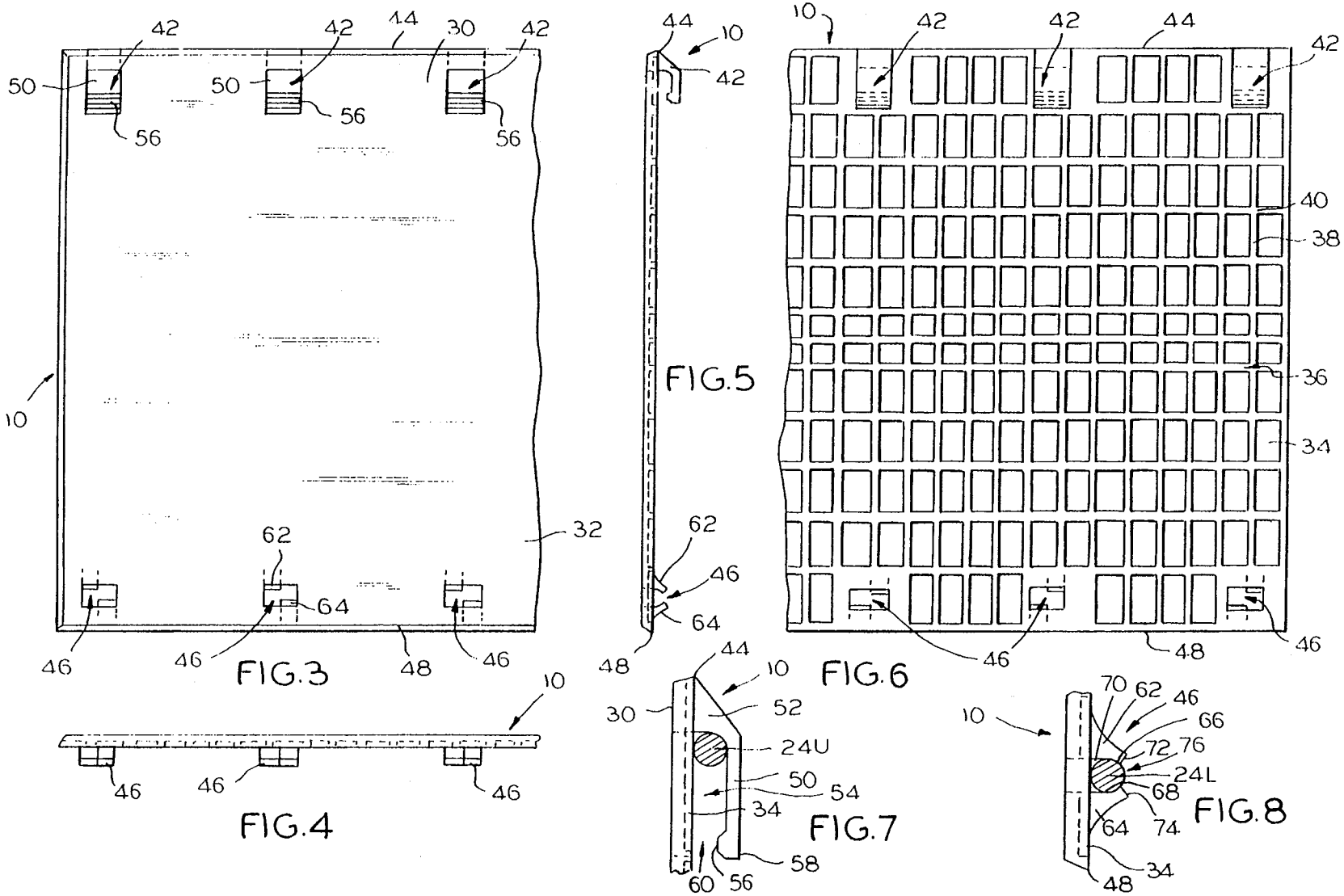
FIG. 3 is a partial front elevation view of the marking plate of FIG. 1.
FIG. 4 is a bottom plan view of the portion of the marking plate shown in FIG. 3.
FIG. 5 is a side elevation view of the marking plate of FIG. 3.
FIG. 6 is a rear elevation view of the marking plate of FIG. 3.
FIG. 7 is a partial side elevation view particularly illustrating a top fastener of the marking plate of FIG. 3.
FIG. 8 is a partial side elevation view illustrating a bottom fastener of the marking plate of FIG. 3.

With particular reference to FIG. 7, each first fastener 42 comprises an arm 50 connected at one end 52 to the plate 30 and extending generally parallel to the rear surface 34 to define a pocket 54. Particularly, the arm 50 is spaced from the rear surface 34 a distance generally corresponding to the outer diameter of an upper cage horizontal wire 24U, as shown. The arm 50 includes a shoulder 56 at its distal edge 58 to define a narrow passage 60 opening to the pocket 54. Particularly, the passage 60 is narrower than the outer diameter of the wire 24U.

With particular reference to FIG. 6, each second fastener 46 comprises a pair of opposite fingers 62 and 64 having respective generally arcuate inner surfaces 66 and 68. The inner surfaces 66 and 68 are spaced apart proximate the rear surface 34 a distance at least equal to the outer diameter of a lower cage vertical wire 24L. Thus, the fingers 62 and 64 define a pocket 70 for receiving the vertical wire 24L. The fingers 62 and 64 outwardly converge toward one another at distal edges 72 and 74 to define a passage 76 opening to the pocket 70. The distal edges 72 and 74 are spaced apart a narrower distance than the diameter of the wire 24L.

In accordance with the invention, the second fastener pocket 70 is laterally spaced from the first fastener pocket 54 a distance corresponding to vertical spacing between the upper and lower horizontal wires 24U and 24L. The marking plate 10 is mounted to the cage 22 initially by fastening the first fasteners 42 to the upper horizontal wire 24U. Particularly, the marking plate 10 is positioned frontwardly of the cage 22 with the shoulders 56 of each first front fastener 42 positioned immediately above a portion of one of the horizontal wire 24U. The plate 10 is then pushed downward so that the wire 24L1 acting on the shoulder 56 causes the arm 50 to deflect outwardly until the wire 24U is received in the passage 54 to provide a snap fit for retaining the wire 24U in the pocket 54. As such, the first fasteners 42 pivotally mount the marking plate 10 to the cage 22. Particularly, the marking plate 10 can be pivoted about the connected wire 24U.

The marking plate 10 is then pivotal so that the second fasteners 46 are positioned proximate the lower horizontal wire 24L, see FIG. 1, with the wire 24L immediately outwardly of the passage 76. The installer then presses on the plate 30 so that the portion of the wire 24L acts on the finger distal edges 72 and 74 so that they are slightly deformed away from one another to permit entry of the wire 24L into the passage 70 to provide a snap fit for retaining the wire 24L in the pocket 70.

Once installed, the marking plate 10 can be used as by adhering marking labels to the front surface 32. Additionally, the front surface 32 can be engraved with information, such as identifying the manufacturer or shipper, as necessary.

A significant advantage with the marking plate 10 is the ability to remove the same. The snap fit connection of both the bottom fasteners 46 and the top fasteners 42 permit easy removal. This is accomplished by pulling on the plate 30 at the bottom edge 48 until the wire 24L is no longer retained in the pocket 70. The marking plate 10 is then lifted so that the upper wire 24U is removed from the first fastener pocket 54.

By making the marking plate 10 removable, it can be used for any desire length of time and then removed and replaced with a new marking plate without destroying the cage 22. The old marking plate. 10, owing to its plastic construction, can then be recycled to provide a new marking plate or any other suitable article.

By making the marking plate 10 of molded plastic, the cost is significantly reduced from that of conventional marking plates. Owing to the reduced cost and easy installation and removal, a marking plate 10 can be installed, if necessary or desired, on any or all of the four sides of the cage 22. Owing to the ease of installation, this can be done at any time so that any given intermediate bulk container 12 can include any number of marking plates 10.

Thus, in accordance with the invention, there is illustrated and described a removable plastic marking plate for an intermediate bulk container.

I claim:

1. A removable marking plate for use with a storage apparatus including a wire mesh cage, comprising:

a plate with a front surface and a rear surface and having a shape corresponding to the shape of the wire mesh cage to be carried on the cage with the rear surface in surface contact with the cage, the front surface being adapted to receive marking information; and a plurality of fasteners extending rearwardly from the plate, each fastener including a pocket for capturing a portion of wire from the cage to retain the plate on the cage and a passage narrower than a diameter of the wire and opening to the pocket to provide a snap fit for retaining the wire in the pocket while permitting removal therefrom, wherein at least some of said fasteners comprise an arm connected at one end of the plate and extending generally parallel to the rear surface to define the pocket and having a shoulder at a distal end extending toward the rear surface to define the passage, such fasteners hingedly mounting the plate to the cage, the marking plate being of one piece plastic construction.

2. The marking plate of claim 1 wherein at least some of the fasteners comprise a pair of opposite fingers spaced apart a distance at least equal to the diameter of the wire to define the pocket, the fingers outwardly converging toward one another so that their distal edges are spaced apart a narrower distance to define the passage.

3. The marking plate of claim 1 wherein said plate is rectangular and the fasteners are spaced along opposite edges of the rectangular plate.

4. The marking plate of claim 3 wherein said fasteners are spaced along top and bottom edges of the plate.

5. A removable marking plate for use with an intermediate bulk container including a vessel surrounded by a wire mesh cage, comprising:

a rectangular plate with a front surface and a rear surface to be carried on the cage with the rear surface in surface contact with the cage, the front surface being adapted to receive marking information;

a plurality of first fasteners, each comprising an arm extending rearwardly from the plate along one side edge to define a pocket for capturing a portion of wire from the cage between the arm and the rear surface to pivotally retain the plate on the cage; and a plurality of second fasteners extending rearwardly from the plate other than at the one side edge, each second fastener including a second pocket for capturing a portion of wire from the cage to retain the plate on the cage and a rearwardly opening passage narrower than a diameter of the wire and opening to the second pocket, so that pivotal movement of the plate about the first fasteners positions the passage at a portion of wire from the cage to be received in the second pocket to provide a snap fit for retaining the wire in the second pocket while permitting removal therefrom.

6. The marking plate of claim 5 wherein each said second fastener comprises a pair of opposite fingers spaced apart a distance at least equal to the diameter of the wire to define the second pocket, the fingers outwardly converging toward one another so that their distal edges are spaced apart a narrower distance to define the passage.

7. The marking plate of claim 5 wherein the marking plate is of one piece plastic construction.

8. The marking plate of claim 5 wherein said second fasteners are spaced along an opposite edge of the rectangular plate relative to the first fasteners.

9. The marking plate of claim 8 wherein said first fasteners are spaced along a top edge of the plate and the second fasteners are spaced along a bottom edge of the plate.

10. The marking plate of claim 5 wherein the marking plate front surface comprises a generally flat surface and said rear surface includes a plurality of rearwardly extending reinforcement ribs.

11. The marking plate of claim 10 wherein the ribs are configured to form a rib grid.

* * * * *